US010285226B2

(12) United States Patent
Kelly et al.

(10) Patent No.: US 10,285,226 B2
(45) Date of Patent: May 7, 2019

(54) DRIVING CIRCUIT AND METHOD FOR A PROVISION OF AN OPERATING CURRENT FOR AT LEAST ONE LIGHTING MEANS

(71) Applicant: TRIDONIC GMBH & CO KG, Dornbirn (AT)

(72) Inventors: Jamie Kelly, Tyne and Wear (GB); Deepak Makwana, Tyne and Wear (GB)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 15/528,232

(22) PCT Filed: Jan. 15, 2016

(86) PCT No.: PCT/EP2016/050776
§ 371 (c)(1),
(2) Date: May 19, 2017

(87) PCT Pub. No.: WO2016/113397
PCT Pub. Date: Jul. 21, 2016

(65) Prior Publication Data

US 2017/0332451 A1 Nov. 16, 2017

(30) Foreign Application Priority Data

Jan. 16, 2015 (GB) ..... 1501141.4

(51) Int. Cl.
*H05B 33/08* (2006.01)

(52) U.S. Cl.
CPC ..... *H05B 33/0815* (2013.01); *H05B 33/089* (2013.01); *H05B 33/0845* (2013.01)

(58) Field of Classification Search
CPC ..... Y02B 70/16
See application file for complete search history.

(56) References Cited

U.S. PATENT DOCUMENTS 6,956,750 B1 10/2005 Eason et al.
7,505,287 B1 3/2009 Kesterson
(Continued)

FOREIGN PATENT DOCUMENTS

GB 2460266 11/2009
GB 2490918 11/2012

OTHER PUBLICATIONS

UK Intellectual Property Office search report in priority application GB1501141.4 dated Aug. 12, 2015.
(Continued)

*Primary Examiner* — Tung X Le
*Assistant Examiner* — Henry Luong
(74) *Attorney, Agent, or Firm* — Andrus Intellectual Property Law

(57) ABSTRACT

The invention is related to a driving circuit that provides an operating current for at least one lighting means. The driving circuit comprises an isolated switched converter having a switch (4) controlled by a control circuit (10), wherein a primary side choke (3) is charged when the switch (4) is in its conducting state and the primary side choke (3) is discharged when the control circuit (10) controls the switch (4) in its non-conducting state. The circuit comprises first determining means (13) for monitoring the current through the primary side choke (3), and second determining means (11) for determining a switch-off time, wherein the second determining means (11) comprises an auxiliary winding (12) coupled to a secondary side choke (6) and the second determining means (11) is configured to monitor the voltage across the auxiliary winding (12) for determining a switch-off time.

10 Claims, 2 Drawing Sheets

(56) References Cited

U.S. PATENT DOCUMENTS

| | | | | |
|---|---|---|---|---|
| 2007/0274112 | A1 | 11/2007 | Lalithambika et al. | |
| 2008/0259656 | A1 | 10/2008 | Grant | |
| 2009/0290390 | A1 | 11/2009 | Piper | |
| 2010/0002480 | A1* | 1/2010 | Huynh | H02M 3/335 363/90 |
| 2012/0212147 | A1 | 8/2012 | Kuo et al. | |
| 2014/0160801 | A1 | 6/2014 | Stamm | |
| 2014/0252981 | A1 | 9/2014 | Xie et al. | |
| 2015/0280584 | A1* | 10/2015 | Gong | H02M 3/33515 363/21.13 |

OTHER PUBLICATIONS

PCT Search Report in parent application PCT/EP2016/050776 dated Apr. 1, 2016.

* cited by examiner

DRIVING CIRCUIT AND METHOD FOR A PROVISION OF AN OPERATING CURRENT FOR AT LEAST ONE LIGHTING MEANS

CROSS REFERENCE TO RELATED APPLICATION

The present application is the U.S. national stage application of International Application PCT/EP2016/050776, filed Jan. 15, 2016, which international application was published on Jul. 21, 2016 as International Publication WO 2016/113397 A1. The International Application claims priority to Great Britain Patent Application 1501 141.4, filed Jan. 16, 2015.

FIELD OF THE INVENTION

The invention relates to a circuit for providing an operating current to at least one lighting means by primary side control of an isolated converter, in particular a flyback converter.

BACKGROUND OF THE INVENTION

For modern lighting means, such as light emitting diodes (LEDs) it is necessary to control the current through such lighting means for adjusting characteristics of the emitted light. In particular, LEDs require a direct current and therefore measures are necessary to operate LEDs in a regular electric power system. Such electric power system provides an alternating voltage that needs to be rectified before it can be supplied to the LED. But rectification alone is not sufficient to operate the LED with the desired output. Thus, after rectification of the alternating voltage, the average current which is supplied to the LED needs to be controlled. By doing so, the emitted spectra and light intensity can be controlled.

Different proposals have been made in order to provide such controlled current. In order to adjust the current through the LED it is known to use switched converters, as for example described in WO 2011/076898. Here, the provision of electrical power to the LED in particular for dimming the LED is described. The average current that is supplied to the LED is dependent on the switch-on time of the switched isolated converter. Since in such isolated converters no direct measurement of the current through the LED is possible, measured values of the primary side of the converter are used to determine the switch-on time and thus in combination with the rectified input voltage, determine the effective current through the LED. But the known solutions for determining the switch-on time of the switched converter are based on the assumption that the elements that are used in the circuit have ideal characteristics. Of course, real elements do not have such ideal characteristics but show parasitic capacitances for example. Such a parasitic capacitance has a negative effect on the measurement, because the process of switching after the switch of the converter is switched off is slower than in an ideal case. As a consequence, the current that is present on the secondary side and thus flows to the LED is larger than expected. More than that, the influence of the parasitic capacitance is dependent also on the load and changes when the LED is dimmed for example. As a consequence the control circuit is not able to adjust the desired current on the output side correctly.

Thus, it is an object of the present invention to provide an improved driving circuit and respective method for providing an operating current to at least one lighting means.

SUMMARY OF THE INVENTION

According to the inventive driving circuit, an isolated switched converter is used to control the current on a secondary side which is to be output to a load connected to the secondary side, like for example a LED module. The primary side of the converter and the secondary side of the converter are coupled by a primary side choke and a secondary side choke for transferring electrical power from the primary side to the secondary side. The primary side choke is charged during switch-on time periods $t_{on}$ and discharged during switch-off time periods $t_{off}$ of a switch that is connected in series to the primary side choke. Switching of the switch is controlled by a control circuit t. That generates a control signal supplied to the switch and based on which the switch is set to its conductive state during switch on times and set to its nonconductive state during its switch off times. For determining the switch-on time $t_{on}$ currents and voltages on the primary side are measured in a known manner. The circuit comprises first determining means for monitoring the current through the primary side choke.

The circuit comprises determining means for determining the beginning of a switch-off time period. The determining means comprises an auxiliary winding coupled to a secondary side choke and the determining means is configured to monitor the voltage across the auxiliary winding for determining a switch-off time.

The determining means may comprise means to detect the beginning of the switch-off time period, preferably by detection when the voltage across the auxiliary winding falls below a first threshold voltage.

The determining means may comprise means to detect the end of the switch-off time, preferably by detection when the voltage across the auxiliary winding exceeds a second threshold voltage.

The control circuit may be configured to detect the beginning of the switch-off time period in a time period after the switch has been switched off.

According to on easpect of the invention, in the circuit there is provided a first determining means for determining a switch-off time. A second determining means may be provided for determining a correction value for future switching cycles. The invention has the advantage that a correction can be performed cycle by cycle, because in every switching cycle the correction value is determined and may be used for the next switching cycle. Thus, changes due to a change in the load can be taken into account immediately and therefore a high quality correction can be achieved. As a result, the switch-on time $t_{on}$ does not include an error due to parasitic effects any longer and the load regulation within a small interval can be ensured for a high dynamic range. It is in particular advantageous that the correction is automatically adapted for different loads that have a strong influence on the effects of parasitic capacitances. For instance, the switches and diodes of the converter may have a parasitic capacitance, e.g. the drain-source capacitance of the switch, which may influence the circuit behavior.

According to an advantageous embodiment, an auxiliary choke is coupled to the secondary side choke for determining the correction value. With such auxiliary choke the voltage over the secondary side choke can be measured and for example by comparing the measured voltage, it can be determined at which point of time a current through the secondary side flows. This point in time then can be used in order to calculate a correction value for correcting the calculated switch-on time $t_{on}$ which is calculated on the basis of measurements on the primary side. Measuring the voltage at the secondary side choke provides a measure for the influence of the parasitic capacitances, because the difference to the primary side measurement of $t_{off}$ gives direct information on the delay in switching due to the parasitic effects.

The measurement of the times as indicated above can be easily performed in a microcontroller or an ASIC or the like. Thus, the sensed values are supplied to such ASIC or microcontroller and then internally used for calculation of the switching times of the switch. The switching signal is then output and fed to the switch accordingly. For the calculation of the switch on time $t_{on}$ of the next cycle the switch off time $t_{off}$ measured on the primary side is therefore corrected by the difference of the switch off time $t_{off}$ and the time measured with aid of the second determining means.

The invention is in particular intended to be used with an isolated converter which is a flyback converter.

Advantages and details of the present invention will now be explained with respect to the annexed drawings.

DETAILED DESCRIPTION

Figure 1:
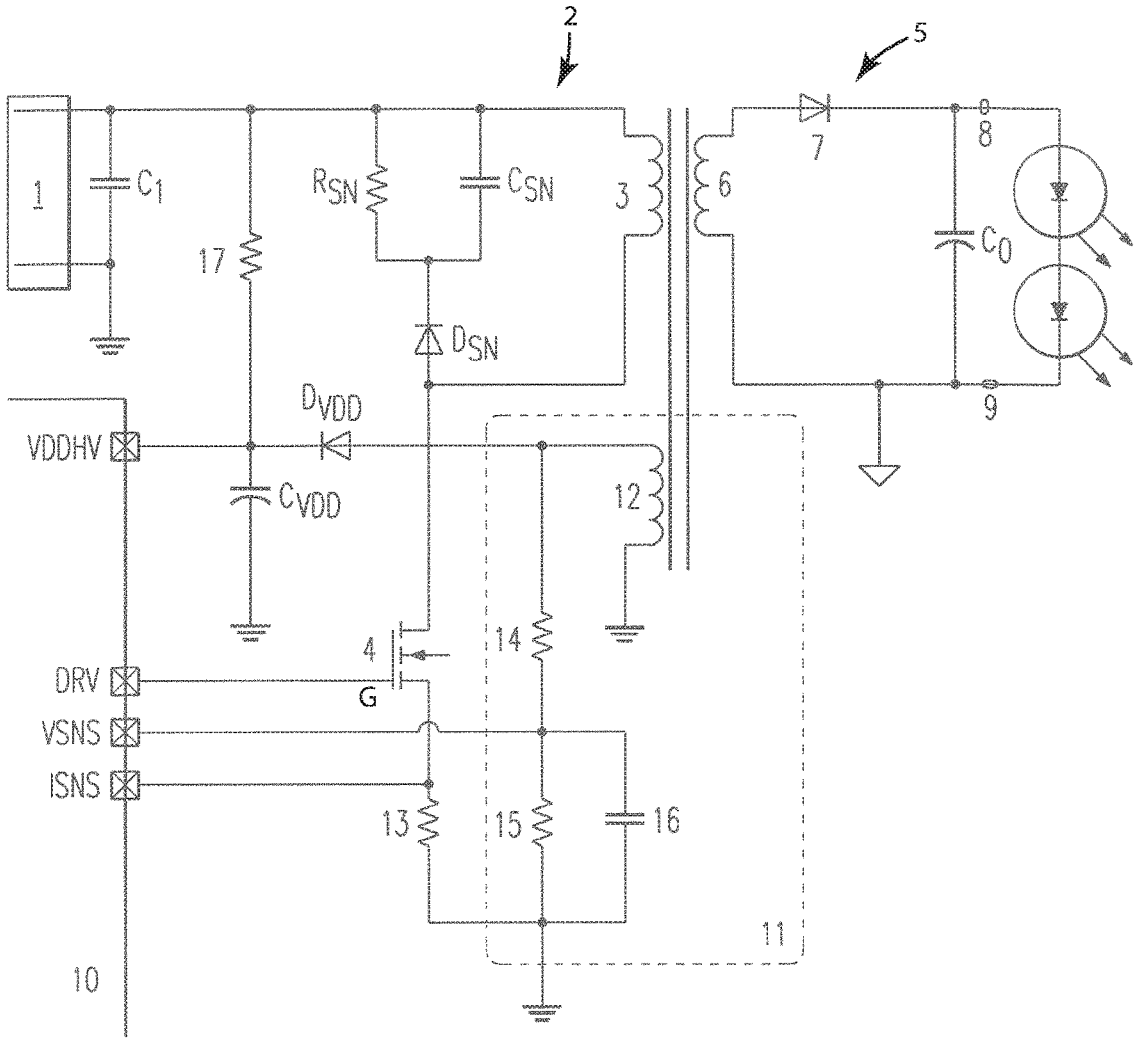
FIG. 1 is a schematic drawing of the driving circuit according to the invention.

FIG. 1 shows a simplified block diagram of an isolated converter of a driving circuit according to the present invention. An alternating voltage like 230V, 50 Hz as commonly used in Europe, is supplied to an AC/DC converter 1 where the alternating voltage is rectified. The rectified voltage is then supplied, as an input voltage, to a flyback converter 2. It is to be noted that although the simplified diagram shows a direct connection between the AC/DC converter 1 and the flyback converter 2, it is possible that further units are present such as for example an active power factor correction unit. It is also possible that the flyback converter 2 is directly (i.e. without AC/DC converter) connected to a rectifier bridge which is coupled to the mains supply voltage, e.g. an alternating voltage like 230V, 50 Hz. For the sake of simplicity of the drawing, such optional additional units are omitted. Furthermore, although the following explanation is given for a flyback converter, the invention can be used with any kind of isolated converter that is switched on its primary side.

For the disclosed structure of the flyback converter 2, it is also to be noted that the general structure thereof is known in the art. Thus, only parts and elements necessary for the understanding of the invention are illustrated and will be explained hereafter. The flyback converter 2 includes a primary side choke 3 and connected in series to the primary side choke 3 a switch 4. Thus, by switching the switch between its conductive and non-conductive state a current through the choke 3 is switched on and off.

On the secondary side an output unit 5 is coupled to the flyback converter 2. The output unit 5 includes a secondary side choke 6 coupled to the primary side choke 3 of the flyback converter 2. Again for sake of simplicity additional elements that are included in the output unit 5 such as capacities and chokes for smoothing and filtering the current and voltage that is fed to the load connected to the output unit 5 are not shown in the drawings but may of course be present. What is shown in addition to the secondary side choke is a diode 7 connected in series to the secondary side choke 6. Voltage and current induced by means of the secondary side choke 3 in the output unit 5 is provided at terminals 8, 9 where for example and LED element is connected.

For providing a pre-determined current or voltage to an LED module that is connected to terminals 8, 9 electrical power is to be transmitted from the primary side choke 3 to the secondary side choke 6. This is achieved by switching the switch 4 on and off. During a switch on time $t_{on}$ of the switch 4 the primary side choke 3 is charged and during a switch off time $t_{off}$ of switch 4 the primary side choke 3 is discharged. As a consequence a current is induced in the secondary side choke 6 as soon as the voltage exceeds a threshold defined by the elements that are in the circuit of the output unit 5 a current starts to flow through diode 7.

Switching of the switch 4 is caused by supplying or not supplying a control signal via terminal G of the switch 4. The switch may be for example a MOSFET. The control signal is generated by a control circuit 10 where not only the time period for a switching cycle is determined but also the switch on time $t_{on}$. On the primary side the current through the primary side choke 3 is measured by a first determining means 13 in order to determine the switch on time $t_{on}$. The first determining means 13 may be formed by a current sensing shunt resistor placed in series with the switch 4 and thus also in series with the primary winding 3.

But according to the invention in addition there is a second determining means 11 for determining the correct switch off time $t_{off}$ and advantageously a correction value. The second determining means 11 comprises an auxiliary winding 12 that is coupled to the secondary side choke 6 and thus to the primary winding 3. Thus, with aid of the measurement of the voltage across the auxiliary winding 12 an information about the delay between the start of the diode 7 to conduct from the point in time where the switch 4 is switched to its off state can be obtained. The auxiliary winding 12 is connected in series with a voltage divider consisting of two resistors 14, 15. Thus, existence of a current through auxiliary winding is measured by the voltage drop over resistor 15. The signal is filtered by a capacitance 16 that is also connected to the center point of the voltage divider where the measurement signal is taken from. Further, an offset voltage may be supplied via an additional resistor 17.

Contrary to a fixed correction value, using the measurement as explained has the advantage that at any point in time a correction is performed on the current load that is connected to terminals 8, 9 and thus for each switching cycle an accurate correction may be performed. Thus, for generating the control signal provided to gate G of the switch 4 the control unit 10 receives information about the switch off time obtained from a current through the switch 4 during its switch on phase. This information is obtained by use of a resistor 13 (forming the first determining means 13) connected in series with the switch 4. Furthermore the second determining means 11 including an auxiliary winding 12 being coupled to the secondary side choke 6 and the primary side choke 3 is used in order to determine the end of switch off time $t_{off}$, preferably by detection when the voltage across the auxiliary winding 12 exceeds a second threshold voltage Vtoff_end. In addition the control unit 10 receives the information of the second determining 11 means about the point in time where actually the diode 7 starts to conduct. The second determining means 11 comprises means to detect the beginning of the switch-off time, preferably by detection when the voltage across the auxiliary winding 12 drops below a first threshold voltage Vtoff_start.

The control circuit 10 may determine a correction value for future switching cycles depending on the determined switch-off time.

Figure 2:
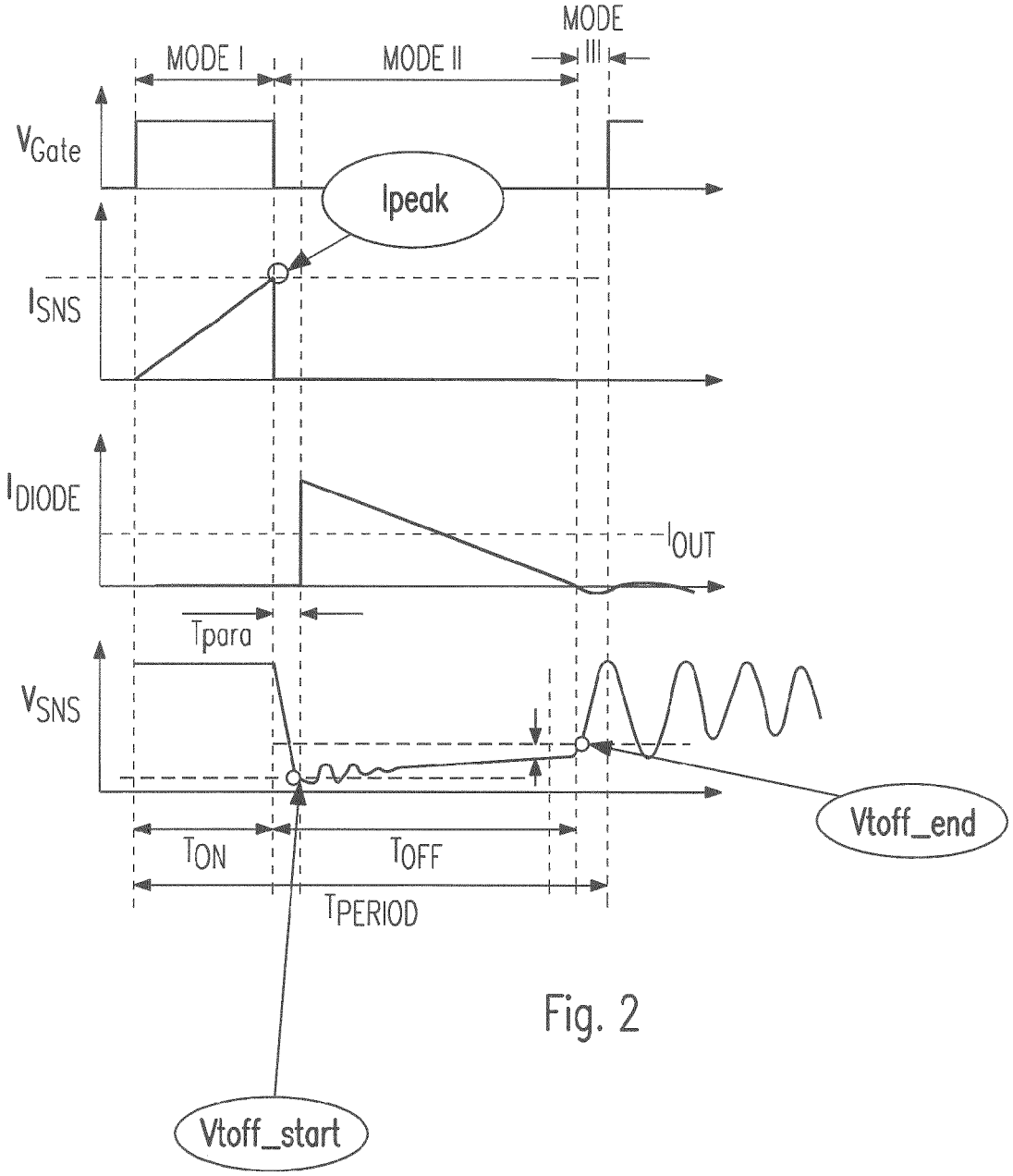
FIG. 2 shows graphs explaining the effect of a parasitic capacity and a determination of a corrected switch-on time $t_{on}$.

FIG. 2 shows a schematic in order to explain the effect of the parasitic capacitance. In the upper most part of the drawing there is shown the control signal which is provided at gate G of the switch 4. During the time period indicated with Mode I the switch 4 is brought into its conductive state. Thereafter the control signal is set back so that during the period of time indicated with Mode II and Mode III the switch 4 is in its non-conductive state.

The diagram below shows the sensed current through the primary side choke 3 which is measured by use of a measurement resistor as explained already above. It can be seen that the current $I_{sns}$ linearly increases as long as the switch 4 is in its conductive state. The circuit comprises first determining means 13 for monitoring the current through the primary side choke 3. In the event where the current through the primary side choke 3 reaches a preset current limit Ipeak the switch 4 will be switched off. The preset current limit Ipeak may be selected depending on the desired level of pre-determined current or voltage which shall be provided to the LED module. When the switch 4 is brought into its non-conductive state it can be seen that the measured current $I_{sns}$ immediately would drop to zero in an ideal case. In practice the switching off of the switch 4 and the interruption of the current flow through the switch 4 might be delayed in comparison to the timing of the event when a control signal at the gate G is switched to a low level, which initiates the switching-off of the switch 4. The switching-off of the switch 4 may be delayed due to parasitic capacitances and thus the on-time ton and the maximum current flowing through the switch 4 and the first determining means 13 may exceed the actually desired value of the preset limit Ipeak. The delayed interruption of current flow through the switch 4 may cause an undesired prolongation which may need to be considered and preferrably corrected.

Below this diagram there is shown the current through the diode 7 indicated with $I_{diode}$, It can be seen that there is a delay between switching off the switch 4 and the diode 7 starting to conduct. This delay is caused by the parasitic capacitances of the switch 4 and the diode 7 as also explained above and shall be taken into consideration by the present invention for determining of a correct $T_{off}$-time so that a given current on the secondary side can be achieved. Without the correction, the effective current on the secondary side does not correspond to the calculated one. Thus, $t_{off}$ needs to be corrected.

The influence of the parasitic capacitances of the time distance Tpara between initiation of switch off of switch 4 by the control signal at gate G and the starting point of the diode conducting the current $I_{diode}$ can impact the current through the (LED) load. At high (LED) loads the parasitic capacitances will be discharged faster and thus the impact of the parasitic capacitance on the duration of this time distance Tpara will be lower compared to an operation at low load.

The current through the switch 4 and the diode 7 is shown in FIG. 2 in an abstract way in order to illustrate the function of this invention and operating sequence of the circuit. In reality there would be a transition period where the current through the switch 4 would be taken over by the diode 7 and thus the current through the switch 4 is going down at a similar rate as the current through the diode 7 increases.

As it is shown in the diagram below the starting point of the diode conducting the current $I_{diode}$ can be recognized from the sensed voltage $V_{sns}$ which is the voltage measured by the second determining means being coupled to the secondary side choke 6. The second determining means 11 is configured to monitor the voltage across the auxiliary winding 12 for determining a switch-off time. According to the invention the second determining means 11 may detect the correct beginning of the switch-off time, preferably by detection when the voltage across the auxiliary winding 12 falls below a first threshold voltage Vtoff_start. The control circuit 10 is preferably configured to detect the beginning of the switch-off time in a time period after the switch 4 has been switched off. This means that the control circuit 10 may activate the monitoring of the the voltage across the auxiliary winding 12 for detection of the beginning of the switch-off phase after the control circuit 10 has switched off switch 4 by an according control signal.

The end of the switch-off time may be detected when the voltage across the auxiliary winding 12 exceeds a second threshold voltage Vtoff_end.

Depending on the kind of operation of the driving circuit the control circuit may switch on the switch 4 immediately after such end of the switch-off time has been detected or after a certain voltage level has been reached. For instance the switch on event of switch 4 may be synchronized to the monitored voltage over the auxiliary winding in a way that switching at low losses will be achieved (so called soft-switching). One option would be to apply a kind of valley switching.

The switch on time may be thus calculated on the basis of a switch off time measured on the primary side, advantageously with the aid of the second determining means 11, and the correction value. The correction value for future switching cycles may depend on the determined switch-off time. The necessary switch on time may be adjusted by adjustment of the preset limit Ipeak which defines the threshold for detection of the appropriate switch on time.

In at least one embodiment the preset limit Ipeak may be adjusted depending on the detection when the voltage across the auxiliary winding 12 drops below a first threshold voltage Vtoff_start during the previous switching cycle. The adjustment of the preset limit Ipeak may depend on the time distance Tpara between the event where control signal which at gate G is switched to a low level which initiates switch off of the switch 4 and the event where the voltage across the auxiliary winding 12 drops below a first threshold voltage Vtoff_start. For instance the preset limit Ipeak may be reduced if the time distance Tpara exceeds a certain time limit.

In at least one embodiment the output voltage which corresponds to the LED voltage may be detected. The output voltage may be detected by a measurement of the voltage across the auxiliary winding 12 during the conduction time of the diode 7. For instance the voltage across the auxiliary winding 12 may be measured at a time point where it can be assumed that conduction of diode 7 has started and the voltage across the auxiliary winding 12 has not exceeded a second threshold voltage Vtoff_end yet. The time point to measure voltage across the auxiliary winding 12 can be defined out of evaluation of earlier switching cycles where the duration of the off-time has been determined. The voltage over the secondary side choke 6 equals the sum of the voltage over the diode 7. In knowledge of the turns ratio of the primary side choke 3 to the secondary side choke 6 the voltage across the auxiliary winding 12 can be used in order to determine the output voltage at the load that is connected to terminals 8, 9. Thus it is possible to detect indirectly the output voltage by a measurement of the voltage across the auxiliary winding 12 during the conduction time of the diode 7 which is the time period where the primary side choke 3 is discharged.

In at least one embodiment the preset limit Ipeak may be adjusted depending on the basis of circuit factors, e.g. depending on the level of input voltage supplied to a flyback converter 2 and/or the output voltage which may be detected indirectly as described above and/or the actual level of the load. The actual level of the preset limit Ipeak may be selected depending on a pre-determined current or voltage which shall be provided to an LED module. Thus the actual level of the preset limit Ipeak is an indication of the load. The actual level of the load may be also detected out of dimming information provided to the flyback converter 2 or control circuit 10, e.g. a dimming signal.

By selection of the appropriate switch on and switch off times the output current and thus the LED current may be controlled by the driving circuit. By selection of the appropriate switch on time and switch off time and thus by the adjustment of the preset limit Ipeak the influence of parasitic effects may be reduced. The adjustment of the preset limit Ipeak according to this invention may be performed in addition or on top of a selection of a preset limit Ipeak which is selected in order to achieve a pre-determined current or voltage which shall be provided to an LED module.

What is claimed is:

1. A driving circuit for provision of an operating current for at least one LED lighting module, the driving circuit comprising:

a control circuit;

an isolated switched converter having a switch (4) controlled by the control circuit (10), wherein a primary side choke (3) is charged when the switch (4) is in its conducting state and the primary side choke (3) is discharged when the control circuit (10) controls the switch (4) in its non-conducting state;

first determining means (13) for monitoring a current through the primary side choke (3) and providing a current signal ($I_{SNS}$) to the control circuit; and second determining means (11) comprising an auxiliary winding (12) coupled to a secondary side choke (6) and configured to monitor a voltage across the auxiliary winding (12) and provide a voltage signal ($V_{SNS}$) to the control circuit;

wherein the control circuit is programmed with a first threshold voltage (Vtoff_start) and a second threshold voltage (Vtoff_end), and is further configured to detect a beginning of a switch off time by detecting when the voltage across the auxiliary winding (12) falls below the first threshold voltage (Vtoff_start) and to detect an end of the switch off time by detecting when the voltage across the auxiliary winding (12) exceeds the second threshold voltage (Vtoff_end), and is further configured to correct a switch on time for future switching cycles based at least in part on the detected beginning and end of the switch off time.

2. The driving circuit according to claim 1 wherein the isolated switched converter is a flyback converter (2).

3. The driving circuit according to claim 1, wherein the control circuit (10) is configured to determine a correction value for the future switching cycles depending on a determined switch-off time.

4. The driving circuit according to claim 3 wherein the control circuit (10) is configured to calculate the switch on time for the future switching cycles on the basis of the switch off time measured on the primary side and the correction value.

5. The driving circuit according to claim 4 wherein the isolated switched converter is a flyback converter (2).

6. A method for controlling an operating current for at least one LED lighting module by an isolated switched converter, the method comprising the steps of:

supplying a direct voltage to the isolated switched converter;

switching a current through a primary side choke (3) on and off, thereby transferring electric power to a secondary side choke (6);

determining a switch off time based on a measurement of a voltage across an auxiliary winding (12) coupled to the secondary side choke (6), wherein a beginning of the switch off time is determined based on a measurement of the voltage across the auxiliary winding (12), by detecting when the voltage across the auxiliary winding (12) falls below a first threshold voltage (Vtoff_start) and an end of the switch off time is determined based on a measurement of the voltage across the auxiliary winding (12), by detecting when the voltage across the auxiliary winding (12) exceeds a second threshold voltage (Vtoff_end); and correcting a switch on time for future switching cycles based at least in part on a detected beginning and end of the switch off time.

7. The method according to claim 6 wherein the beginning of the switch off time is determined in a time period after a switch (4) has been switched off.

8. The method according to claim 6 wherein the step of correcting the switch on time for the future switching cycles based at least in part on the detected beginning and end of the switch off time comprises:

determining a correction value for the switch on time of a future cycle.

9. The method according to claim 8, wherein the correction value is determined on the basis of the measurement of the voltage across the auxiliary winding (12).

10. The method according to claim 9, wherein the switch on time is calculated on the basis of the switch off time measured on the primary side and the correction value.

* * * * *